US012751495B2

(12) United States Patent
Erguven

(10) Patent No.: US 12,751,495 B2
(45) Date of Patent: Oct. 6, 2026

(54) AEROSOL PROVISION SYSTEM

(71) Applicant: Nicoventures Trading Limited, London (GB)

(72) Inventor: Nejat Erguven, London (GB)

(73) Assignee: Nicoventures Trading Limited, London (GB)

( * ) Notice: Subject to any disclaimer, the term of this patent is extended or adjusted under 35 U.S.C. 154(b) by 406 days.

(21) Appl. No.: 18/286,199

(22) PCT Filed: Apr. 8, 2022

(86) PCT No.: PCT/GB2022/050895
§ 371 (c)(1),
(2) Date: Oct. 9, 2023

(87) PCT Pub. No.: WO2022/214832
PCT Pub. Date: Oct. 13, 2022

(65) Prior Publication Data

US 2024/0188638 A1 Jun. 13, 2024

(30) Foreign Application Priority Data

Apr. 9, 2021 (GB) ..... 2105103

(51) Int. Cl.
*A24F 40/53* (2020.01)
*A24F 40/65* (2020.01)
*A24F 40/60* (2020.01)

(52) U.S. Cl.
CPC ..... *A24F 40/53* (2020.01); *A24F 40/65* (2020.01); *A24F 40/60* (2020.01)

(58) Field of Classification Search
CPC ..... A24F 1/00; A24F 3/00; A24F 5/00; A24F 7/00; A24F 9/00; A24F 11/00;
(Continued)

(56) References Cited

U.S. PATENT DOCUMENTS 8,272,875 B1 * 9/2012 Jurmain ..... G16H 50/50 434/238
2009/0210088 A1 * 8/2009 Nielsen ..... G07F 7/00 700/231
(Continued)

FOREIGN PATENT DOCUMENTS

CN 109782670 A 5/2019

OTHER PUBLICATIONS

Translated Notification of the First Office Action from corresponding Chinese Application No. 2022800323299, mailed Apr. 9, 2026, all pages cited in its entirety.

*Primary Examiner* — Daniel Previl
(74) *Attorney, Agent, or Firm* — Burr & Forman

(57) ABSTRACT

There is provided a method of locking a non-combustible aerosol provision system. The method can include receiving user input representative of a request to lock the non-combustible aerosol provision system after a given period of time, and allowing the non-combustible aerosol provision system to be used to generate aerosols during the given period of time. The method further can include locking, in response to determining that the given period of time has elapsed, the non-combustible aerosol provision system to prevent the non-combustible aerosol provision system from being used to generate aerosols.

21 Claims, 4 Drawing Sheets

(58) Field of Classification Search

CPC ..... A24F 13/00; A24F 15/00; A24F 17/00; A24F 19/00; A24F 21/00; A24F 23/00; A24F 25/00; A24F 29/00; A24F 27/00; A24F 31/00; A24F 40/00; A24F 42/00; A24F 47/00; A24F 2700/00; A24F 40/10; A24F 40/50; A24F 40/60; A24F 40/40; A24F 15/015; A24F 40/48; A24F 40/485; A24F 40/90; A24F 40/95; A24F 40/65; A24F 40/30; A24F 40/51; A24F 15/005; A24F 40/53; A61M 2209/045; A61M 15/06; A61M 11/042; A61M 2205/3584; A61M 2205/3592; A61M 2205/8206; A61M 11/005; A61M 15/00; A61M 15/0003; A61M 15/0021; A61M 15/008; A61M 15/0081; A61M 15/0083; A61M 15/009; A61M 2016/0039; A61M 2205/3368; A61M 2205/3379; A61M 2205/35; A61M 2205/3553; A61M 2205/3576; A61M 2205/3653; A61M 2205/3693; A61M 2205/502; A61M 2205/52; A61M 2205/581; A61M 2205/582; A61M 2205/583; A61M 2205/588; A61M 2205/60; A61M 2205/609; A61M 2205/75; A61M 2230/04; A61M 2230/30; A61M 2230/42; A61M 2230/50; B65B 3/04; B65B 37/06; B65B 1/00; B65B 3/00; B65B 5/00; B65B 7/00; B65B 9/00; B65B 11/00; B65B 13/00; B65B 15/00; B65B 17/00; B65B 19/00; B65B 21/00; B65D 25/005; B65D 1/00; B65D 3/00; B65D 5/00; B65D 7/00; B65D 9/00; B65D 13/00; B65D 11/00; B65D 15/00; B65D 17/00; B65D 19/00; G01F 23/00; G01F 3/00; G01F 1/00; G01F 5/00; G01F 7/00; G01F 9/00; G01F 11/00; G01F 13/00; G01F 15/00; G01F 17/00; G01F 19/00; G01F 22/00; G09F 2023/0025; H02J 50/10; H02J 7/00; H02J 7/35; H02J 7/70; H02J 7/731; H02J 7/855; A61B 5/1118; A61B 5/681; A61B 5/0024; A61B 5/01; A61B 5/0205; A61B 5/021; A61B 5/02405; A61B 5/02438; A61B 5/0533; A61B 5/14542; A61B 5/682; A61B 5/6898; G16H 20/10; G16H 20/13; G16H 20/30; G16H 20/70; G16H 40/67; A63F 13/212; A63F 13/825; F22B 1/284; G06F 1/163; G06F 18/22; G06F 18/23; G06F 21/32; G06F 21/44; G06F 21/6209; G06F 21/64; G06F 2221/2111; G06F 2221/2129; G06F 2221/2135; G06F 2221/2149; G06F 3/017; G06F 3/16; G06F 16/2358; G06F 16/29; G06F 1/00; G06F 3/00; G06F 5/00; G06F 7/00; G06F 8/00; G06F 9/00; G06F 11/00; G06F 12/00; G06F 13/00; G06F 15/00; G06F 16/00; G06F 17/00; G06F 18/00; G06F 21/00; G06F 30/00; G06F 40/00; G06F 2101/00; G06F 2111/00; G06F 2113/00; G06F 2115/00; G06F 2117/00; G06F 2119/00; G06F 2123/00; G06F 2200/00; G06F 2201/00; G06F 2203/00; G06F 2205/00; G06F 2206/00; G06F 2209/00; G06F 2207/00; G06F 2211/00; G06F 2212/00; G06F 2221/00; G06F 2219/00; G06F 2218/00; G06F 2216/00; G06F 2213/00; G08C 17/02; G08C 2201/42; G08C 2201/93; H04L 67/535; H04W 4/029; H04Q 9/00; H04M 1/72412; H04M 1/72415

USPC ..... 340/309.16, 305, 332, 815.48, 384.71, 340/385.1, 393.2

See application file for complete search history.

(56) References Cited

U.S. PATENT DOCUMENTS

| | | | | |
|---|---|---|---|---|
| 2013/0023850 | A1* | 1/2013 | Imran | A61N 1/325 604/501 |
| 2015/0181945 | A1* | 7/2015 | Tremblay | A24F 40/65 131/328 |
| 2016/0150824 | A1* | 6/2016 | Memari | A24F 40/95 131/329 |
| 2016/0219931 | A1* | 8/2016 | Doshi | A24F 47/00 |
| 2016/0242461 | A1* | 8/2016 | Rawlins | B65D 85/1009 |
| 2016/0331036 | A1* | 11/2016 | Cameron | H04Q 9/00 |
| 2019/0158938 | A1* | 5/2019 | Bowen | A24F 40/65 |
| 2020/0137570 | A1 | 4/2020 | Skoda | |
| 2020/0170298 | A1* | 6/2020 | Lee | A24F 40/20 |
| 2020/0199909 | A1* | 6/2020 | Fridley | G07C 9/00912 |
| 2021/0000184 | A1 | 1/2021 | Moloney et al. | |

* cited by examiner

AEROSOL PROVISION SYSTEM

PRIORITY CLAIM

The present application is a National Phase entry of PCT Application No. PCT/GB2022/050895, filed Apr. 8, 2022, which claims priority from GB Application No. 2105103.2, filed Apr. 9, 2021, each of which hereby fully incorporated herein by reference.

TECHNICAL FIELD

The present disclosure relates to the field of non-combustible aerosol provision systems. In particular, but not exclusively, the present disclosure relates to locking and unlocking a non-combustible aerosol provision system.

BACKGROUND

A "non-combustible" aerosol provision system is an aerosol provision system where a constituent aerosol-generating material of the aerosol provision system (or component thereof) is not combusted or burned in order to facilitate delivery of at least one substance to a user.

The non-combustible aerosol provision system may be an electronic cigarette, also known as a vaping device or electronic nicotine delivery system (END), although it is noted that the presence of nicotine in the aerosol-generating material is not a requirement.

The non-combustible aerosol provision system may be an aerosol-generating material heating system, also known as a heat-not-burn system. An example of such a system is a tobacco heating system.

The non-combustible aerosol provision system may be a hybrid system to generate aerosol using a combination of aerosol-generating materials, one or a plurality of which may be heated. Each of the aerosol-generating materials may be, for example, in the form of a solid, liquid or gel and may or may not contain nicotine. The hybrid system may comprise a liquid or gel aerosol-generating material and a solid aerosol-generating material. The solid aerosol-generating material may comprise, for example, tobacco or a non-tobacco product.

Typically, the non-combustible aerosol provision system may comprise a non-combustible aerosol provision device and a consumable for use with the non-combustible aerosol provision device.

The non-combustible aerosol provision system, such as a non-combustible aerosol provision device thereof, may comprise a power source and a controller. The power source may, for example, be an electric power source or an exothermic power source. The exothermic power source comprises a carbon substrate which may be energized so as to distribute power in the form of heat to an aerosol-generating material or to a heat transfer material in proximity to the exothermic power source.

The non-combustible aerosol provision system may comprise an area for receiving the consumable, an aerosol generator, an aerosol generation area, a housing, a mouthpiece, a filter and/or an aerosol-modifying agent.

The consumable for use with the non-combustible aerosol provision device may comprise aerosol-generating material, an aerosol-generating material storage area, an aerosol-generating material transfer component, an aerosol generator, an aerosol generation area, a housing, a wrapper, a filter, a mouthpiece, and/or an aerosol-modifying agent.

Known approaches are described in WO2017/001817A1, WO2019/104223A1, WO2018/165758A1, WO2018/165758A1, and US2020/008481A1.

SUMMARY

Viewed from a first aspect, there is provided a method of locking a non-combustible aerosol provision system, the method comprising: receiving user input representative of a request to lock the non-combustible aerosol provision system after a given period of time; allowing the non-combustible aerosol provision system to be used to generate aerosols during the given period of time; and in response to determining that the given period of time has elapsed, locking the non-combustible aerosol provision system to prevent the non-combustible aerosol provision system from being used to generate aerosols. Thus there is provided an efficient and effective approach for managing resource consumption of a non-combustible aerosol provision system.

Viewed from a second aspect, there is provided a non-combustible aerosol provision system configured to: receive user input representative of a request to lock the non-combustible aerosol provision system after a given period of time; allow the non-combustible aerosol provision system to be used to generate aerosols during the given period of time; and lock, in response to determining that the given period of time has elapsed, the non-combustible aerosol provision system to prevent the non-combustible aerosol provision system from being used to generate aerosols. Thus there is provided an efficient and effective approach for assisting a user in controlling usage of a non-combustible aerosol provision system.

Viewed from a third aspect, there is provided a system for locking a non-combustible aerosol provision system, the system comprising: the non-combustible aerosol provision system; a user device in communication with the non-combustible aerosol provision system and configured to receive user input representative of a request to lock the non-combustible aerosol provision system after a given period of time; the user device configured to allow the non-combustible aerosol provision system to be used to generate aerosols during the given period of time; and the user device is responsive to determining that the given period of time has elapsed, to lock the non-combustible aerosol provision system to prevent the non-combustible aerosol provision system from being used to generate aerosols.

Viewed from a fourth aspect, there is provided a computer-readable medium comprising instructions which, when executed by processing circuitry of a non-combustible aerosol provision system, cause the non-combustible aerosol provision system to: receive user input representative of a request to lock the non-combustible aerosol provision system after a given period of time; allow the non-combustible aerosol provision system to be used to generate aerosols during the given period of time; and lock, in response to determining that the given period of time has elapsed, the non-combustible aerosol provision system to prevent the non-combustible aerosol provision system from being used to generate aerosols.

BRIEF DESCRIPTION OF FIGURES

Embodiments and examples of the present approaches will now be described, by way of example only, with reference to the accompanying drawings, in which.

Figure 1:
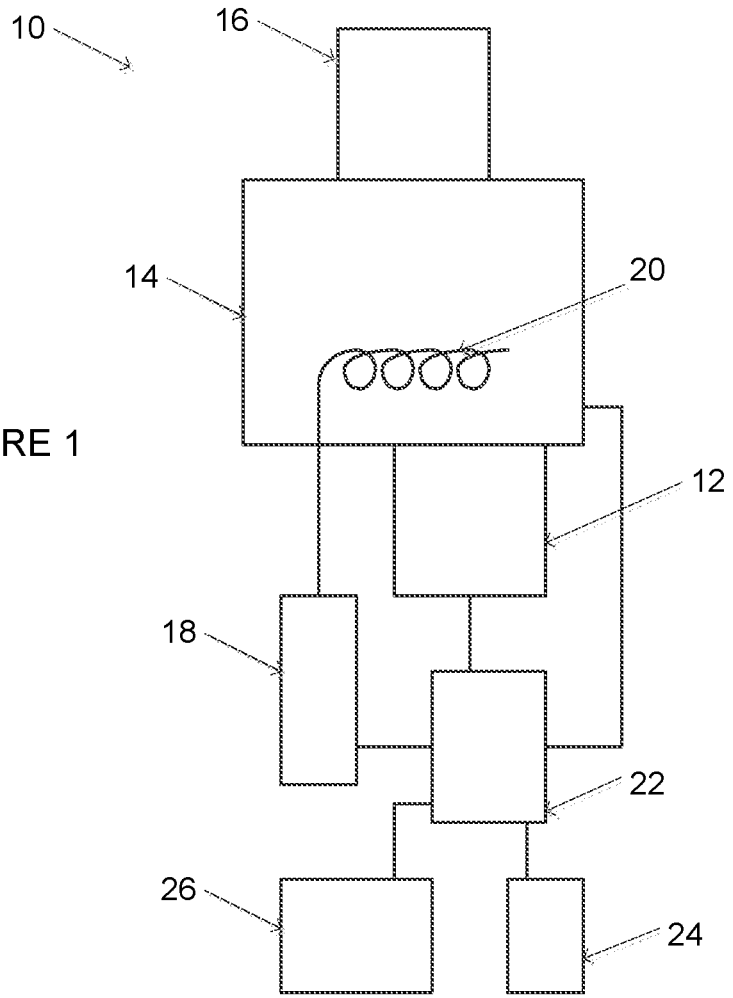
FIG. 1 is a schematic illustrating an example of a non-combustible aerosol provision system.

While the presently described approach is susceptible to various modifications and alternative forms, specific embodiments are shown by way of example in the drawings and are herein described in detail. It should be understood, however, that drawings and detailed description thereto are not intended to limit the scope to the particular form disclosed, but on the contrary, the scope is to cover all modifications, equivalents and alternatives falling within the spirit and scope as defined by the appended claims.

DETAILED DESCRIPTION

With a traditional cigarette, the length of a session of smoking is linked to the burning of the cigarette itself. That is, after smoking for (typically) approximately three minutes, the cigarette will have burned away and the user will put out and dispose of the cigarette stub. The physical characteristics of a cigarette therefore provide an inherent time limit after which the user faces friction if they wish to continue smoking i.e., they must light another cigarette.

However, with a non-combustible aerosol provision system, the supply of aerosolizable material (also termed aerosol-generating materials and/or aerosol medium) that can be stored by the non-combustible aerosol provision system may be sufficient for several minutes or even hours of use. This provides a high level of convenience to the user since the user can operate the non-combustible aerosol provision system for an extended period of time without having to replace the cartridge or otherwise top-up the supply of aerosolizable material in the non-combustible aerosol provision system.

The present techniques provide an approach by which a non-combustible aerosol provision system can be locked after a given period of time has elapsed. This therefore allows provision of a user experience in which friction is experienced if it is desired to continue aerosol generation following the end of a time-limited session of use of the non-combustible aerosol provision system.

Further, by locking the non-combustible aerosol provision system after the given period of time, this functionality, which may be referred to a lockout timer functionality, can help to control the amount of aerosolizable material used by the non-combustible aerosol provision system as well as the amount of battery used. Accordingly, by making use of the lockout timer functionality, the non-combustible aerosol provision system may be usable for a longer period of elapsed time since the supply of aerosolizable material and battery level may depleted more slowly than an approach in which this functionality is not employed.

Additionally, by locking the non-combustible aerosol provision system after the given period of time in this way, the security of the system may be improved. Since the non-combustible aerosol provision system is locked after the given period of time has elapsed, if someone other than the owner/user of the system were to have access to the system, they may find the system to be inoperable when in the locked state or only operable for the remaining period of time until the non-combustible aerosol provision system is locked. Consequently, the lockout timer functionality may reduce the likelihood that the owner's supply could be used by another person acting maliciously or inadvertently with the owner's device and/or act as a deterrent for a potential thief.

Additionally, where the given period of time is set to end at a predetermined time (i.e. at a certain time of day), the outcomes of providing control on use of aerosolizable material, control on use of battery and/or additional security may be further achieved. For example, if a user has a certain time of day after which they know that they will be in a location where aerosol generation is not permitted, they can set the non-combustible aerosol provision system to lock from that time of day so as to prevent use by the user or any other person after that time of day. Similar considerations would apply to a user who wishes to set time limits on their aerosol generation, thus again creating friction in the event that the user attempts to use the non-combustible aerosol provision system after the time of day has passed (i.e. after the period of time has elapsed).

It will be appreciated that the present approaches involve transmission of data to and from a non-combustible aerosol provision system, and for the non-combustible aerosol provision system to process stored and/or received data. Also, the present approaches require a user device to be capable of communicating with a non-combustible aerosol provision system. Such a user device may be capable of communicating with other services or systems. Therefore, to illustrate suitable devices for providing such functionalities, an example non-combustible aerosol provision system 10 and an example user device 40 are illustrated with respect to FIGS. 1 and 2 respectively.

An example of a non-combustible aerosol provision system 10 is schematically illustrated in FIG. 1. As shown, the aerosol delivery device 10 is a device which contains elements relating to aerosol generation such as an aerosol medium container or cartridge 12 (in the case of an END device, the aerosol medium container or cartridge 12 will contain nicotine or a nicotine-bearing formulation), an aerosol generation chamber 14 and an outlet 16 through which a generated aerosol may be discharged. A battery 18 may be provided to power a thermal generator element (such as a heater coil 20) within (or functionally adjacent to) the aerosol generation chamber 14. The battery 18 may also power a processor/controller 22 which may serve purposes of device usage, such as activation of the device for aerosol generation in response to an activation trigger, and purposes of communication and functionality control. Processor/controller 22 may have access to a memory 24 which may be used to store operating instructions for the processor/controller 22. The memory 24 may also be used to store data describing operating conditions and/or states of the non-combustible aerosol provision system 10 and/or one or more components thereof. The memory 24 may be internal to the processor/controller 22 or may be provided as an additional separate physical element.

To perform transmission and reception of data and/or messaging, the processor/controller 22 is provided with a transmitter/receiver element 26. The transmitter/receiver element 26 enables the non-combustible aerosol provision system 10 to communicate with a connected device using a connectivity technology such as a personal area network protocol. Example personal area network protocols include Bluetooth™, Bluetooth Low Energy™ (BLE), Zigbee™, Wireless USB, and Near-Field Communication (NFC). Example personal area network protocols also include protocols making use of optical communication such as Infrared Data association (IrDA), and data-over-sound. Other wireless technologies such as a Wi-Fi™ technology may be used if the non-combustible aerosol provision system has suitable capability. In other examples, the transmitter/receiver element 26 may be configured to provide for a wired communication channel provided between physical ports of the non-combustible aerosol provision system 10 and a connected device. Such a wired communication channel may utilize a physical connection technology such as USB™, a serial port, FireWire™ or other point-to-point wired connectivity. The remainder of this discussion will use the example of BLE and will use BLE terminology, although it will be appreciated that corresponding or equivalent functionalities of other personal area network technologies may be substituted. Thus, in the present example, the transmitter/receiver element 26 is a BLE interface element including or connected to a radio antenna for wireless communication. In other examples such as those indicated above this may be an interface element for an alternative wireless technology and/or a wired connection interface.

Any communication established with a connected device may be impermanent or otherwise transient in the sense that the channel may be established for a period of time necessary to carry out specific functionalities, but may also be disconnected when not required. For this reason such a connected device will be referred to herein as a user device, in the sense that the device is likely to be utilized and/or controlled by a user of the non-combustible aerosol provision system 10 and a connected device. An example of such a user device (which may also be termed a remote device, in the sense that the device is remote from the non-combustible aerosol provision system, or intermediary device, in the sense that the device is intermediate between the non-combustible aerosol provision system and the unlock/age verification services) is described below with reference to FIG. 2.

Returning to the discussion of FIG. 1, the processor/controller 22 may in one example be an STM32 microcontroller as provided by ST Microelectronics and based on the ARM™ Cortex™-M processor. In other examples an alternative microcontroller or processor may be used, which may be based upon an ARM™ architecture, and Atom™ architecture or other low power processor technology. Alternatively or additionally, the transmitter/receiver element 26 may in one example include an nRF BLE chip for cooperating with the processor/controller to provide BLE connectivity to the non-combustible aerosol provision system. In other examples, other communication interface chips or modules may be deployed to provide connectivity services.

As illustrated, processor/controller 22 may be connected for example to aerosol medium container or cartridge 12, aerosol generation chamber 14 and battery 18. This connection may be to an interface connection or output from ones of the components and/or may be to a sensor located at or in ones of the components. These connections may provide access by the processor to properties of the respective components. For example a battery connection may be used to control activation of the non-combustible aerosol provision system for aerosol generation.

Further functionalities of the processor/controller 22 and/or the memory 24 will be described with reference to the examples of the present approaches below.

Figure 2:
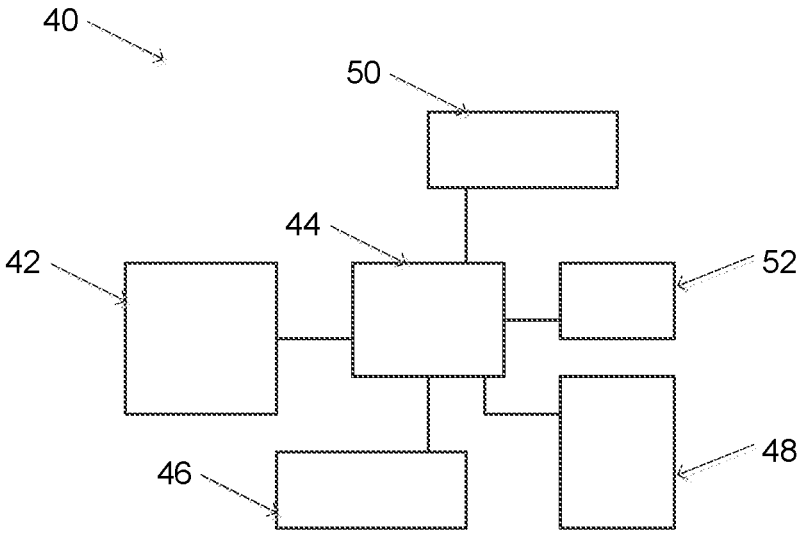
FIG. 2 is a schematic illustrating an example of a user device.

An example of a user device 40 is schematically illustrated in FIG. 2. The user device may be a device such as a mobile telephone (cellphone) or tablet of a user (and/or owner) of the non-combustible aerosol provision system 10. As shown, the user device 40 includes a receiver transmitter element 42 for communicating with a non-combustible aerosol provision system 10. Thus the receiver transmitter element 42 will be configured to use the same connectivity and protocols, etc., as the non-combustible aerosol provision system 10 with which it is to interact in any given implementation. Accordingly, in the present examples, the receiver transmitter element 42 is a BLE interface element including or connected to a radio antenna for wireless communication. In other examples such as those indicated above this may be an interface element for an alternative wireless technology and/or a wired connection interface.

The receiver transmitter element 42 is connected to a processor or controller 44 which can receive and process the data or messaging received from the non-combustible aerosol provision system. The processor or controller 44 has access to a memory 46 which can be used to store program information and/or data. The user device 40 may include a further data transmission interface 48. This interface may provide one or more interface functionalities, for example to a wired connection such as wired local area network and/or to a wireless connection such as wireless local area network and/or cellular data services. This interface may be used for example for sending and receipt of messaging to and from various other devices, computer systems, and/or computer services as required by any particular implementation. This interface may also or alternatively be used for communications relating to other functionalities of the user device 40 which are unrelated to operation of or interaction with a non-combustible aerosol provision system.

The user device 40 also includes user interface elements including an output device 50 (which may include one or more of a display, an audio output, and a haptic output) and an input device 52 (which may include one or more of buttons, keys, touch-sensitive display elements, or a mouse/trackpad).

The user device 40 may be pre-programmed or configured to provide the functionalities according to the approaches discussed below. Additionally or alternatively, the user device may store software (e.g. in memory 46) such as an app to cause the processor or controller 44 to have those functionalities when the software is executed. Thus the user device may be a multi-purpose device that has the described functionalities when the app is executed.

Software to cause the user device to become programmed for the techniques described herein may also be embodied or encoded in a computer-readable medium, such as a computer-readable storage medium, containing instructions. Instructions embedded or encoded in a computer-readable medium may cause a programmable processor, or other processor, to perform the method, e.g., when the instructions are executed. Computer-readable media may include non-transitory computer-readable storage media and transient communication media such as carrier signals and transmission media. Computer readable storage media may include random access memory (RAM), read only memory (ROM), programmable read only memory (PROM), erasable programmable read only memory (EPROM), electronically erasable programmable read only memory (EEPROM), flash memory, a hard disk, a CD-ROM, a floppy disk, a cassette, magnetic media, optical media, or other computer-readable storage media. The term "computer-readable storage media" refers to physical storage media. Transient communication media may occur between components of a single computing system (e.g. on an internal link or bus between e.g. a memory and processor) or between separate computing systems (e.g. over a network or other inter-computing device connection), and may include transmission signals, carrier waves or the like.

Such software may be loaded directly to the user device 40 from a computer-readable medium, or may be loaded to the user device by connecting the user device to another computing device (such as a desktop computer, laptop computer or the like) and using software on the other computing device to control the loading of software to the user device.

Thus there have been described a non-combustible aerosol provision system and a user device that may interact to provide a number of additional functionalities for the non-combustible aerosol provision system to a user of the user device. Examples of such functionalities will now be described.

Figure 3:
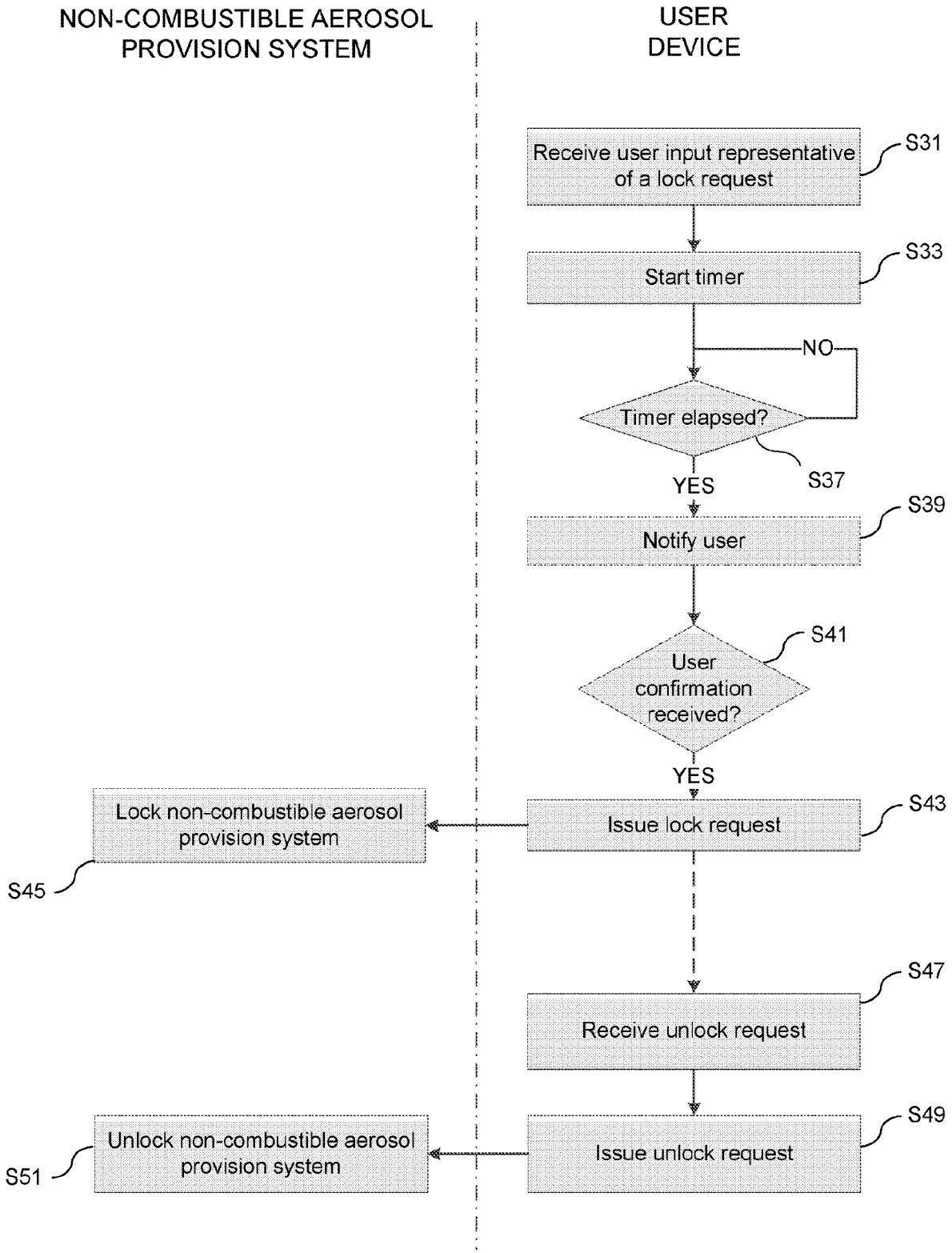
FIG. 3 is a flowchart illustrating a method of locking a non-combustible aerosol provision system according to a first example.

FIG. 3 is a flowchart illustrating a method of locking a non-combustible aerosol provision system according to a first example. Shown within dashed lines are operations that are carried out in the present example but that may not be performed in all examples. Additionally it will be appreciated that the operations relating to unlocking the non-combustible aerosol provision system may not be carried out, or may be carried out in a different manner in other examples.

As shown in S31 of FIG. 3, user input representative of a request to lock the non-combustible aerosol provision system 10 is received. In this example, it is assumed that the non-combustible aerosol provision system 10 is already in an unlocked state (i.e. in a state where aerosol generation is possible). In the example of FIG. 3, this input is received at the user device 40, however in some examples the user input is received at the non-combustible aerosol provision system 10 itself (e.g., by pressing a button on the device, or causing an airflow indicative of commencing aerosol generation, which can be termed puffing). One example is discussed in more detail in relation to FIG. 4. The user input may be received in any suitable manner including via input device 52 (which may include one or more of buttons, keys, touch-sensitive display elements, or a mouse/trackpad). As will become apparent from the discussion below, the input is considered indicative of a lock request in that the method causes the user input to commence a process which ultimately provides for the non-combustible aerosol provision system to be locked after it has been available for use for a defined period.

The user may enter a given period of time for which the non-combustible aerosol provision system 10 is to be operable before it is locked and may click an enter button to confirm their selection. In such an example, the user specifies, with the user input, the amount of time until the non-combustible aerosol provision system 10 is to be locked. However, in some examples, the user input does not indicate the amount of time, and a default or preset amount of time (e.g., three minutes) is used as the given period of time.

In response to receiving the user input at S31, a timer is started at S33. In the example shown in FIG. 3, the timer is started on the user device 40 which comprises a processor or controller 44 arranged to maintain the timer. The timer could also be started by providing an indication to the non-combustible aerosol provision system 10 which may include the amount of time for which the timer is to run. For example, the user device 40 could communicate via Bluetooth with the non-combustible aerosol provision system 10 to write to the non-combustible aerosol provision system 10 a value indicative of the time for which timer should be set. In response, the non-combustible aerosol provision system 10 may start a timer on the device 10 itself. In other implementations, rather than the period of time entered by the user setting a time interval during which aerosol generation is to be permitted, the time period could be a time (e.g. a time of day) until which aerosol generation is to be permitted. In such implementations, the timer is started and monitoring the duration of the timer would involve comparing a current time to the set lock time, which comparison may be performed multiple times until the set time is reached, or the comparison may be performed once so as to determine a remaining interval and the remaining interval may then be checked in the manner indicated above.

Irrespective of how the timer is started, during the given period of time for which the timer is running, the non-combustible aerosol provision system 10 is maintained in the unlocked state, until the timer expires. As used herein, the terms "locked" and "unlocked" refer to whether the non-combustible aerosol provision system 10 can be used to generate aerosols. Accordingly, when in the locked state, the non-combustible aerosol provision system 10 is restricted from generating aerosols. This may be achieved for example by preventing power being applied to a thermal generator element of the non-combustible aerosol provision system 10. Conversely, when in the unlocked state, the non-combustible aerosol provision system 10 can be used to generate aerosols, subject to any other restrictions (e.g., holding down a button/the user puffing on the device). That is, when in the unlocked state, the non-combustible aerosol provision system 10 does not necessarily produce aerosols, but rather is in a state in which the device permits the generation of aerosols.

As such, while the timer is running, the non-combustible aerosol provision system 10 is allowed to be used to generate aerosols, as illustrated by the "NO" output from S37 of FIG. 3.

Once the given period of time has elapsed as detected by the timer, the method causes the non-combustible aerosol provision system 10 to be locked to prevent the non-combustible aerosol provision system being used to generate aerosols, as illustrated by the "YES" output from S37 in FIG. 3.

The process of locking the non-combustible aerosol provision system 10 may take any of a number of suitable forms and in one example, the user device 40 is configured to issue a lock request to the non-combustible aerosol provision system 10 in response to the given period of time elapsing (whether the period of time elapsing corresponds to elapse of a set time interval or to elapse of a duration until a set time of day). In another example in which the user device 40 provided an indication to the non-combustible aerosol provision system 10 on receipt of the user input, the timer is implemented on the non-combustible aerosol provision system 10 itself and the device 10 is configured to lock itself in response to detecting that the timer has elapsed (again whether the period of time elapsing corresponds to elapse of a set time interval or to elapse of a duration until a set time of day).

As shown in the example of FIG. 3, in response to the given period of time elapsing, the user device 40 is configured to notify the user at S39. Notifying the user may take the form of delivering a push notification to the user device 40. Such a notification may comprise an audible element and/or haptic feedback to alert the user, e.g. using the output device 50. Notifying the user may additionally or alternatively involve notifying via the non-combustible aerosol provision system 10. For example, the non-combustible aerosol provision system 10 may be configured to light up and/or flash a light-emitting diode (LED) on the device 10. Thus, after notifying the user at S39, the method may skip directly to S43.

Whilst the notification may be used solely to notify the user that the timer has elapsed and that the non-combustible aerosol provision system 10 is to be locked automatically, in this example, the notification at S39 is also used to seek user confirmation that the non-combustible aerosol provision system 10 is to be locked. This approach therefore provides a prompt to the user regarding locking of the device 10 but without preventing the further generation of aerosols if the user wishes to continue using the device.

If the user does not confirm that the non-combustible aerosol provision system 10 is to be locked, then the locking process aborts and the device 10 remains in the unlocked state. In some examples, another timer may be commenced such as to re-prompt the user after the timer re-elapses (for example by providing a "NO" output from S41 to the input of S37—not shown). In other examples, a lack of confirmation from the user at S41 may simply terminate the process and leave the non-combustible aerosol provision system in the unlocked state. However, if user confirmation is received at S41, then the method proceeds ("YES" output from S41) and the non-combustible aerosol provision system 10 is locked.

In this example, locking the non-combustible aerosol provision system 10 involves issuing a lock request by the user device 40 at S43 to the non-combustible aerosol provision system 10. The lock request is transmitted using the receiver transmitter element 42 of the user device 40 and received by the transmitter/receiver element 26 of the non-combustible aerosol provision system 10. In this example, the transmission of the lock request occurs via BLE, however, it will be appreciated that any suitable communication technology such as those mentioned above may be used.

In response to the lock request, the non-combustible aerosol provision system 10 is configured to lock the non-combustible aerosol provision system 10 at S45 to prevent the non-combustible aerosol provision system from being used to generate aerosols. In this way, the present techniques are able to implement lockout timer functionality to automatically restrict the use of the non-combustible aerosol provision system 10 to a given period of time. As discussed above, this may provide additional security for the non-combustible aerosol provision system 10 since a person other than the owner of the device 10 attempting to use the device 10 maliciously or inadvertently may be prevented from using the non-combustible aerosol provision system 10 or restricted in the amount of time for which they can the device before the device 10 is locked.

This approach may also provide a better user experience by more closely resembling the experience of a cigarette for which sessions of use are inherently time-limited due to the burning away of the cigarette itself. Additionally, by restricting the time for which the non-combustible aerosol provision system 10 can be used, resources of the non-combustible aerosol provision system 10 such as battery level and aerosolizable material may be conserved, thereby allowing the device 10 to be used for a longer period of elapsed time before charging/replacing a cartridge.

Once the non-combustible aerosol provision system 10 has been locked as illustrated by S45 in FIG. 3, the non-combustible aerosol provision system 10 may remain in the locked state until unlocked by the user. In other words, once the non-combustible aerosol provision system 10 has been placed into the locked state, the method may then remain dormant until such time as an unlock request is received. The user device 40 may therefore be arranged to receive an unlock request at S47 (e.g., when the user wishes to begin another session of use). At this point the user device 40 may immediately issue an unlock request at S49 to cause the non-combustible aerosol provision system 10 to be unlocked at S51. However, in some examples, the user device 40 requires authentication following or as part of receiving the unlock request at S47 that the person unlocking the non-combustible aerosol provision system 10 is authorized to unlock the device 10. As such, the user device 40 may require the user to perform an authentication process (e.g., by inputting a PIN or password) before the user device 40 proceeds with unlocking the non-combustible aerosol provision system 10.

As noted above, the example shown in FIG. 3 assumes that the non-combustible aerosol provision system 10 starts the process in an unlocked state. In other examples where the starting state of the non-combustible aerosol provision system is locked, the method may additionally include receiving an unlock request, issuing an unlock request and unlocking the non-combustible aerosol provision system (similar to S47, S49 and S51) prior to S31. In further examples where the starting state of the non-combustible aerosol provision system is locked, the user input at S31 may be used as both an unlock request and a lock request, with the method issuing an unlock request and the non-combustible aerosol provision system being unlocked responsive to the user input, at a time before or approximately simultaneous with the starting of the timer. Any such unlock request may be subjected to authorization as mentioned above with respect to S47.

Thus there has been described an approach which allows use of a non-combustible aerosol provision system to be time constrained. As mentioned above, this may provide for extending the charge of the battery, extending the lifetime of a reserve of aerosolizable material, increased security, and/or may provide for controlled/reduced intake of aerosols for the user.

Figure 4:
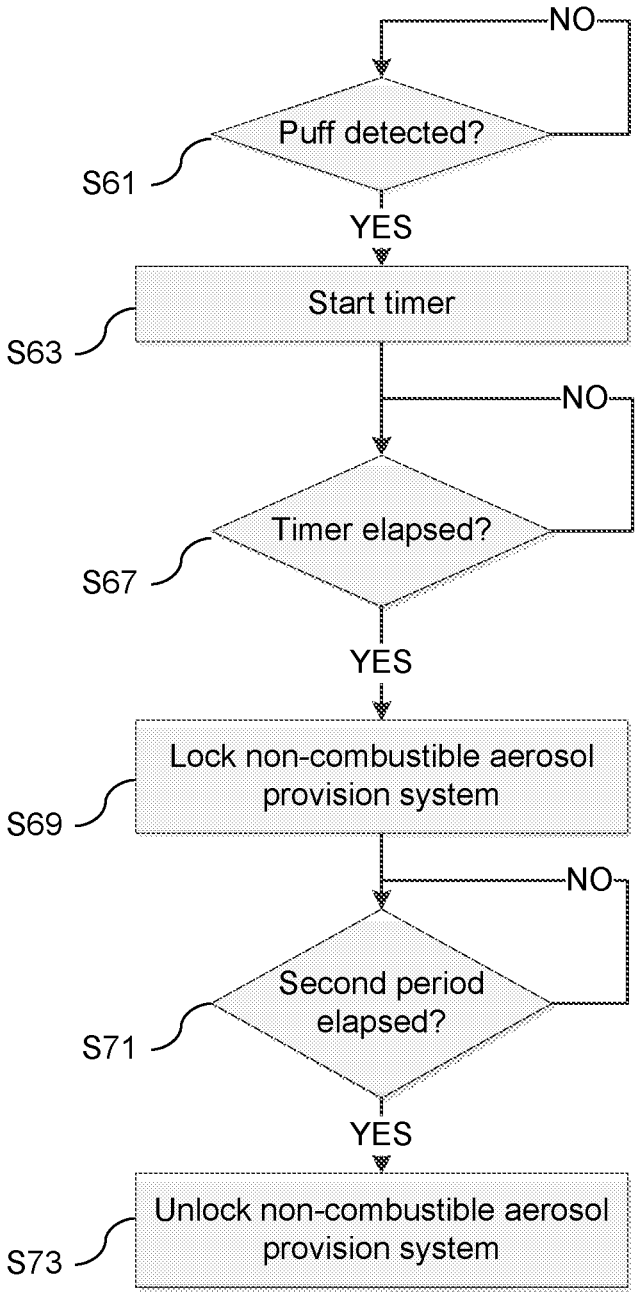
FIG. 4 is a flowchart illustrating a method of locking a non-combustible aerosol provision system according to a second example.

FIG. 4 is a flowchart illustrating a method of locking a non-combustible aerosol provision system according to a second example. In this example, the non-combustible aerosol provision system is again assumed to commence the method in an unlocked state. In the example described with reference to FIG. 3, the user input was received at the user device 40 and the timer was implemented by the user device 40 with a lock request issued to the non-combustible aerosol provision system 10 once the given period of time had elapsed. In the example of FIG. 4 however, the lockout timer functionality is implemented entirely locally on the non-combustible aerosol provision system 10. This means that the non-combustible aerosol provision system 10 does not need to be in communication with the user device 40 in order to make use of the lockout timer functionality, thereby allowing the user to take advantage of the lockout timer functionality even in the absence of the user device 40. Furthermore, this approach means that the timer can be started without the need for interaction with the user device 40, which may provide additional convenience to the user.

Many of the features/operations illustrated in FIG. 4 correspond closely to analogous features/operations described above in relation to FIG. 3. For brevity, a full description of these features/operations will not be repeated below and reference should instead be made to the description of the corresponding operation/feature of FIG. 3.

Turning to FIG. 4, S61 illustrates that the non-combustible aerosol provision system 10 is responsive to detecting a puff on the non-combustible aerosol provision system 10. In this example, the user puffing on the non-combustible aerosol provision system 10 constitutes the user input representative of a request to lock the non-combustible aerosol provision system 10. That is, by puffing on the device 10, the user signals to the non-combustible aerosol provision system 10 that he or she wishes to initiate a session of use after which the non-combustible aerosol provision system 10 is to be locked. In this way, the non-combustible aerosol provision system 10 is able to automatically restrict the use of the device 10 to sessions of a predetermined period of time (e.g., three minutes) or to restrict that after a session has been commenced a lock will occur at a set time (e.g. a specific time of day). As an alternative to using puff detection as an initiator for the method, in examples in which the non-combustible aerosol provision system 10 is provided with one or more input elements (such as a button or touch-sensitive input) the method may be commenced by a particular button press (such as pressing a particular button, pressing one or more buttons for a certain duration, and/or multiple button presses over a predetermined time/sequence of buttons.

In response to detecting the puff on the device 10 as indicated by S61, the non-combustible aerosol provision system 10 starts the timer at S63. While the timer is running, the non-combustible aerosol provision system 10 allows the non-combustible aerosol provision system 10 to be used to generate aerosols. That is, the non-combustible aerosol provision system 10 is maintained in (e.g. not removed from) the unlocked state while the timer is running.

After the given period of time has elapsed (whether the period of time elapsing corresponds to elapse of a set time interval or to elapse of a duration until a set time of day), as detected by the timer, the non-combustible aerosol provision system 10 is configured to then lock itself at S69 and thereby prevent the non-combustible aerosol provision system 10 from being used to generate aerosols. Hence, the non-combustible aerosol provision system 10 is able to perform all of the operations of the method to lock itself without the need for intervention by user device 40.

The non-combustible aerosol provision system 10 may remain locked until unlocked via the user device 40 as described above with reference to FIG. 3. However, in this example, the non-combustible aerosol provision system 10 implements a back-off timer. With the back-off timer, the non-combustible aerosol provision system 10 keeps the non-combustible aerosol provision system 10 in the locked state for a second period of time following the non-combustible aerosol provision system 10 being locked, as illustrated with S71. Once this second period of time has elapsed, the non-combustible aerosol provision system 10 is configured to unlock itself at S73 to allow the device 10 to again be used to generate aerosols. This second period of time may be a time interval or may be a set time (e.g. a time of day).

At this point, the non-combustible aerosol provision system 10 may return to a state equivalent to the state before the puff was detected in S61. Consequently, puffing on the non-combustible aerosol provision system 10 after the device 10 has been unlocked would begin the lockout timer again.

As noted above, the example shown in FIG. 4 assumes that the non-combustible aerosol provision system 10 starts the process in an unlocked state. In other examples where the starting state of the non-combustible aerosol provision system is locked, the method may additionally include an initial unlock operation. Such an initial unlock operation could be included in S61 such that puff detection (or some other activation detection as discussed above) causes unlocking, or could be a separate operation requiring an alternative user input such as use of an input element to perform an unlock instruction. In such examples, S73 rather than actually unlocking the non-combustible aerosol provision system, would instead permit the non-combustible aerosol provision system to become unlocked in response to an unlock request (which would not be possible before the second period has elapsed).

Thus there has been described another approach in which usage of a non-combustible aerosol provision system for aerosol generation may be time-limited following an initial event. In this example the initial event is provided by puff detection, or by detection of some other suitable user input on the non-combustible aerosol provision system. This time-limited approach to permitting aerosol generation may provide extending the charge of the battery, extending the lifetime of a reserve of aerosolizable material, and/or may provide for controlled/reduced intake of aerosols for the user. These outcomes may be further emphasized by use of the back-off timer.

Although the approach of FIG. 4 uses the back-off timer, it would be possible (as mentioned above) to treat this features optional and thus end the process of FIG. 4 at S69.

Moreover, although the approach of FIG. 3 does not include a back-off timer, it will be appreciated that this approach can also deploy a back-off timer. In such an example, monitoring for a second time period corresponding to the back-off timer may be implemented following S43. Until the back-off timer has completed (e.g. the second time period has elapsed) the method may ignore or decline any received unlock request.

Figure 5:
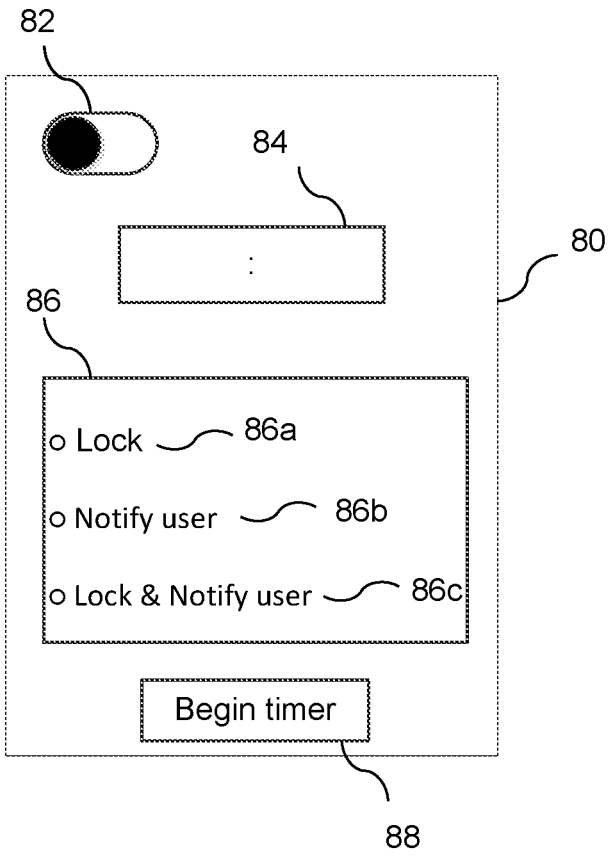
FIG. 5 is a schematic illustrating a user interface for controlling the locking of a non-combustible aerosol provision system.

An example of a user interface screen that may be provided to a user by the output device 50 of the user device 40 to invite and/or receive user input is shown in FIG. 5.

As shown, the user interface screen 80 comprises a selection element 82 for enabling/disabling the lockout timer functionality. In this example, the selection element 82 is depicted as a switch which can be toggled by the user to enable or disable the lockout timer functionality and which displays a current state of the setting. When the lockout timer functionality is disabled, the above-described approach whereby the non-combustible aerosol provision system 10 is locked after the given period is time may is not used, whereas when the lockout timer functionality is enabled this approach is used.

Further control over the implementation of the lockout timer is provided via a timer duration field 84. The timer duration field 84 may be used to specify the given period of time for which the non-combustible aerosol provision system 10 is to remain in the unlocked state following the user input representative of the request to lock the non-combustible aerosol provision system 10. The timer duration field 84 therefore allows the user to control how long a session should be before the non-combustible aerosol provision system 10 is locked. As described above, this may be set to a default value, or may even be absent if there is a non-changeable default value. In implementations where the timer if implemented as a time until which the non-combustible aerosol provision system will remain unlocked, the timer duration field 84 may be used to set the time (e.g. time of day) at which locking is to occur rather than an interval after which the locking is to occur.

The user is also able to control the action or actions taken once the given period of time has elapsed via control element 86. As shown in FIG. 5, control element 86 comprises three radio buttons 86*a*-86*c*. The first radio button 86*a* corresponds to locking of the non-combustible aerosol provision system 10 in response to the timer elapsing (which may include a set time of day being reached). With this option selected therefore, the non-combustible aerosol provision system 10 is locked once the timer elapses and the user may not be notified or confirmation requested.

With the second radio button 86*b* selected, the user is notified once the timer has elapsed. This notification may indicate to the user that the given period of time has elapsed and may in some cases also provide the option to the user to confirm that the non-combustible aerosol provision system 10 should be locked. The third radio button 86*c* corresponds to both locking the non-combustible aerosol provision system 10 and notifying the user once the given period of time has elapsed.

As shown in FIG. 5, the user interface screen further comprises a button 88 to start the lockout timer. The user input representative of a request to lock the non-combustible aerosol provision system 10 may therefore comprise pressing of this button 88 to indicate to the user device 40 that the timer is to be started. Where the timer is set as a time to be reached rather than a time interval, the pressing of the button may be used to commence testing whether the set time has been reached.

Although not shown, further user interface elements may be provided to select (or deselect) use of a back-off timer, and also set the duration of such a back-off timer).

Hence, there has been described an approach by which a non-combustible aerosol provision system can be locked and unlocked, making use of a timer to delay at least the locking process. This therefore allows the user to restrict the length of a session of use of the non-combustible aerosol provision system thereby providing additional security, an improved experience using the non-combustible aerosol provision system, and increased longevity of a supply of aerosolizable material and/or battery supply.

Although it has been described above that the elapsed time being a time interval and the elapsed time being a duration until a set time (e.g. time of day, which can also be referred to as an absolute time and/or a clock time) are alternatives, these can in some implementations be used in combination. For example, a user may specify a first timer as being a time interval to limit the duration of a session, and then where a back-off timer is used this may set a time of day which must be reached before the non-combustible aerosol provision system can be unlocked again—thus providing an implementation in which a user can set themselves the opportunity to undertake one aerosol generation session of a certain maximum length prior to a certain time of day. More complex time interval patterns may also be specified, for example permitting unlimited use until a certain time of day, then a defined number of time-limited aerosol generation sessions, and then no more aerosol generation until another set time of day. A large variety of possible interactions of either or both timer types to create a compound set of time-based controls for use of a non-combustible aerosol provision system for aerosol generation over time are thus envisaged.

In the present application, the words "configured to . . . " are used to mean that an element of an apparatus has a configuration able to carry out the defined operation. In this context, a "configuration" means an arrangement or manner of interconnection of hardware or software. For example, the apparatus may have dedicated hardware which provides the defined operation, or a processor or other processing device may be programmed to perform the function. "Configured to" does not imply that the apparatus element needs to be changed in any way in order to provide the defined operation.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the disclosure as defined by the claims or limitations on equivalents to the claims, and that other embodiments may be utilized and modifications may be made without departing from the scope of the claims. Various embodiments of the disclosure may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. A method of locking a non-combustible aerosol provision system, the method comprising:

receiving user input representative of a request to lock the non-combustible aerosol provision system after a given period of time;

allowing the non-combustible aerosol provision system to be used to generate aerosols during the given period of time; and in response to determining that the given period of time has elapsed, locking the non-combustible aerosol provision system to prevent the non-combustible aerosol provision system from being used to generate aerosols.

2. The method according to claim 1, further comprising:

notifying a user that the given period of time has elapsed;

wherein locking the non-combustible aerosol provision system is additionally in response to receiving confirmation from the user of at least one of:

the non-combustible aerosol provision system is to be locked or the given period of time should be repeated before locking the non-combustible aerosol provision system.

3. The method according to claim 1, wherein the user input is received at a user device in communication with the non-combustible aerosol provision system.

4. The method according to claim 3, further comprising:

notifying the non-combustible aerosol provision system by the user device of the request to lock the non-combustible aerosol provision system after the given period of time;

wherein locking the non-combustible aerosol provision system is in response to determining by the non-combustible aerosol provision system that the given period of time has elapsed.

5. The method according to claim 3, wherein locking the non-combustible aerosol provision system comprises issuing a lock request to the non-combustible aerosol provision system by the user device in response to determining by the user device that the given period of time has elapsed.

6. The method according to claim 1, wherein at least one of:

the user input is received at the non-combustible aerosol provision system or receiving the user input comprises detection of puffing on the non-combustible aerosol provision system by the user.

7. The method according to claim 1, further comprising:

keeping the non-combustible aerosol provision system locked until an unlock request is received by a user device in communication with the non-combustible aerosol provision system.

8. The method according to claim 1, further comprising at least one of:

unlocking the non-combustible aerosol provision system after a second period of time following locking of the non-combustible aerosol provision system has elapsed or unlocking the non-combustible aerosol provision system after a second period of time following locking of the non-combustible aerosol provision system has elapsed, wherein the second period of time comprises a time period elapsing at a predetermined time.

9. The method according to—claim 1, wherein the given period of time comprises a time period ending at a predetermined time.

10. A device configured to:

receive user input representative of a request to lock a non-combustible aerosol provision system after a given period of time;

allow the non-combustible aerosol provision system to be used to generate aerosols during the given period of time; and lock, in response to determining that the given period of time has elapsed, the non-combustible aerosol provision system to prevent the non-combustible aerosol provision system from being used to generate aerosols.

11. The device according to claim 10, further configured to:

notify a user that the given period of time has elapsed;

wherein the non-combustible aerosol provision system is configured to lock the non-combustible aerosol provision system additionally in response to receiving confirmation from the user of at least one of:

the non-combustible aerosol provision system is to be locked or the given period of time should be repeated before locking the non-combustible aerosol provision system.

12. The device according to claim 10, further configured to do at least one of:

unlock the non-combustible aerosol provision system after a second period of time following locking of the non-combustible aerosol provision system has elapsed or unlock the non-combustible aerosol provision system after a second period of time following locking of the non-combustible aerosol provision system has elapsed, wherein the second period of time comprises a time period elapsing at a predetermined time.

13. The device according to claim 10, wherein the device is the non-combustible aerosol provision system.

14. The device according to claim 13, wherein:

the non-combustible aerosol provision system is configured to receive the user input by detecting puffing on the non-combustible aerosol provision system by the user.

15. The device of claim 10, wherein the device is a user device communicatively coupled to the non-combustible aerosol provision system.

16. The device of claim 15, wherein the user device is configured to receive the user input representative of a request to lock the non-combustible aerosol provision system after a given period of time directly at the user device.

17. The device of claim 15, wherein the user device is configured to receive the user input representative of a request to lock the non-combustible aerosol provision system after a given period of time via the non-combustible aerosol provision system.

18. A system for locking a non-combustible aerosol provision system, the system comprising:

the non-combustible aerosol provision system; and the user device according to claim 15.

19. The device of claim 10, wherein the given period of time comprises a time period ending at a predetermined time.

20. A non-transitory computer-readable storage medium comprising instructions which, when executed by processing circuitry of a device, cause the device to become configured to:

receive user input representative of a request to lock a non-combustible aerosol provision system after a given period of time;

allow the non-combustible aerosol provision system to be used to generate aerosols during the given period of time; and lock, in response to determining that the given period of time has elapsed, the non-combustible aerosol provision system to prevent the non-combustible aerosol provision system from being used to generate aerosols.

21. The non-transitory computer-readable storage medium according to claim 20, wherein the instructions cause the device to become configured to:

notify a user that the given period of time has elapsed; and lock the non-combustible aerosol provision system additionally in response to receiving confirmation from the user that the non-combustible aerosol provision system is to be locked.

* * * * *